United States Patent [19]

Okazaki et al.

[11] Patent Number: 4,496,442

[45] Date of Patent: Jan. 29, 1985

[54] PROCESS FOR GENERATING HYDROGEN GAS

[75] Inventors: Toshimasa Okazaki; Akihiro Sakata; Kyozi Nagai; Kazuo Nakashima, all of Aichi, Japan

[73] Assignee: Toagosel Chemical Industry Co., Ltd., Tokyo, Japan

[21] Appl. No.: 482,519

[22] Filed: Apr. 12, 1983

Related U.S. Application Data

[62] Division of Ser. No. 292,981, Aug. 14, 1981, abandoned.

[30] Foreign Application Priority Data

Aug. 14, 1980 [JP] Japan ..... 55-111066

[51] Int. Cl.[3] ..... C25B 1/04; C25B 1/14; C25B 1/16

[52] U.S. Cl. ..... 204/129; 204/49; 204/294

[58] Field of Search ..... 204/129, 294, 128, 98

[56] References Cited

U.S. PATENT DOCUMENTS

| | | | |
|---|---|---|---|
| 3,342,566 | 9/1967 | Schwedhelm et al. | 204/41 X |
| 3,756,925 | 9/1973 | Takeuchi et al. | 204/16 |
| 4,049,841 | 9/1977 | Coker | 427/34 |
| 4,169,025 | 9/1979 | Needes | 204/98 |
| 4,175,023 | 11/1979 | Argade et al. | 204/252 |
| 4,182,670 | 1/1980 | Argade et al. | 204/252 |
| 4,221,643 | 9/1980 | Miles et al. | 204/98 |
| 4,248,680 | 2/1981 | Carlin et al. | 204/98 |
| 4,282,074 | 8/1981 | DuBois | 204/98 |

FOREIGN PATENT DOCUMENTS

| | | | |
|---|---|---|---|
| 2112684 | 12/1973 | Fed. Rep. of Germany | 204/16 |
| 2443669 | 3/1976 | Fed. Rep. of Germany | 204/49 |
| 2634128 | 2/1978 | Fed. Rep. of Germany | 204/49 |
| 34442 | 11/1970 | Japan | 204/294 |
| 48050 | 12/1974 | Japan | 204/49 |
| 1236954 | 6/1971 | United Kingdom | 204/16 |

OTHER PUBLICATIONS

Paul Morisset et al., "Chromium Plating", pp. 38–44 and 87, (1954).

G. A. DiBari, Plating and Surface Finishing, pp. 76–80, Jun. 1979.

*Primary Examiner*—G. L. Kaplan

*Attorney, Agent, or Firm*—Sughrue, Mion, Zinn, Macpeak, and Seas

[57] ABSTRACT

A process and cathode for generating hydrogen gas are described, said cathode being produced by electrically plating the surface of an electrode substrate in a nickel plating bath with fine carbonaceous particles dispersed therein.

8 Claims, 1 Drawing Figure

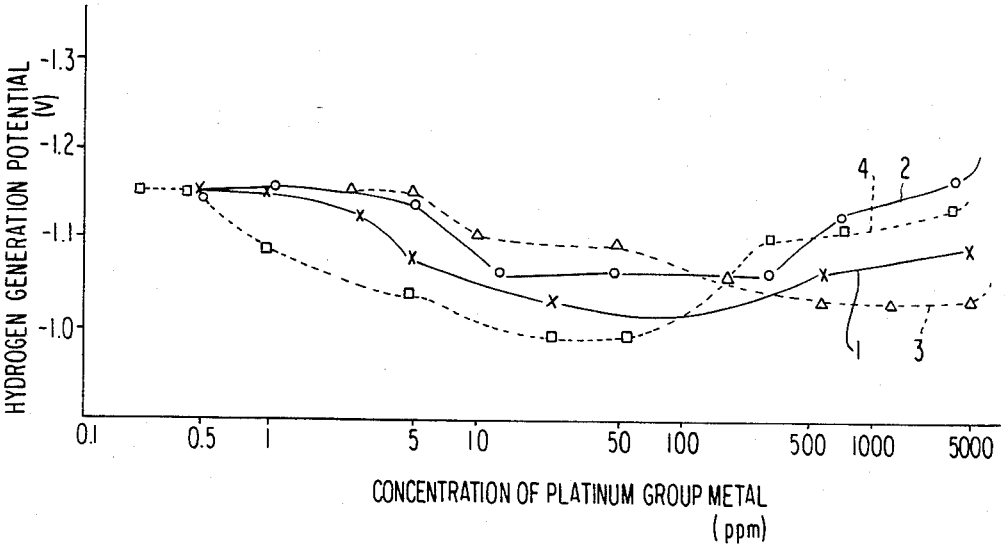
HYDROGEN GENERATION POTENTIAL (V)
-1.3
-1.2
-1.1
-1.0
0.1
0.5
1
5
10
50
100
500
1000
5000
CONCENTRATION OF PLATINUM GROUP METAL (ppm)
1
2
3
4

PROCESS FOR GENERATING HYDROGEN GAS

This application is a division of application Ser. No. 292,981 filed Aug. 14, 1981 and now abandoned.

FIELD OF THE INVENTION

The present invention relates to a process and cathodes for generating hydrogen gas and more particularly to a process for production of cathodes, which show an excellent low hydrogen overvoltage in an aqueous solution of alkali hydroxides, alkali carbonates or other alkali compounds.

BACKGROUND OF THE INVENTION

Methods which have heretofore been used for the generation of hydrogen gas at a cathode include the electrolysis of an aqueous alkali metal salt solution according to diaphragm processes using a porous filter diaphragm such as an asbestos diaphragm or a dense diaphragm such as an ion exchange membrane, and the electrolysis of water.

Recently, from the viewpoint of saving energy, reduction in electrolytic voltage has been desired. As a method of reducing the electrolytic voltage, it has been desired to reduce hydrogen overvoltage of the cathode.

SUMMARY OF THE INVENTION

As a result of extensive studies on the production of a cathode by electric plating of the surface of an electrode substrate in a nickel bath, it has been found that a low hydrogen overvoltage cathode having a long life can be obtained.

The present invention, therefore, provides a cathode for generating hydrogen gas and a process for production of such cathodes, comprising electrically plating the surface of an electrode substrate in a nickel plating bath having fine carbonaceous particles dispersed therein.

BRIEF DESCRIPTION OF THE DRAWING

The FIGURE is a graph showing the relationship between the concentration of various platinum group metals in a plating bath and the hydrogen generation potential of a plated product obtained in Example 7.

DETAILED DESCRIPTION OF THE INVENTION

In accordance with the process of the invention, electric plating is conducted on the surface of an electrode substrate using a nickel bath with fine carbonaceous particles dispered therein, whereby a cathode having an active layer on the substrate is provided. The cathode has long life and greatly reduced hydrogen overvoltage. Further, the process of the invention is very advantageous over the conventional methods in that it permits the production of cathodes inexpensively without complicated steps.

In the invention, any material can be used as the electrode substrate, provided that the material can be nickel-plated and has an anti-corrosion property under the conditions of application, such as iron, stainless steel, copper, nickel and their alloys; materials prepared by plating nickel, copper, chromium, or the like on iron; and valve metals (e.g., titanium, tantalum, niobium, zirconium, etc.) containing platinum group metals or oxides thereof, or those plated with nickel, copper, iron, or the like.

The fine carbonaceous particles to be dispersed in the nickel plating bath include fine particles of carbons such as charcoal, coal, bone carbon, graphite, active carbon, carbon black and cokes, with active carbon made from wood or coconut husk being preferred in terms of performance and economic consideration. While the action of the fine carbonaceous particles is not completely clear, it is believed that the particles roughen the surface of the cathode and increase the catalytic activity, thereby contributing to the reduction in the hydrogen overvoltage of the cathode. These particles can be used more advantageously as the grain size is decreased. The grain size (diameter) is usually 100 microns or less, and preferably 10 microns or less.

Although fine carbonaceous materials available on the market have a very wide distribution of grain size, those materials containing at least 50 wt% of particles having grain size of 100 microns or less are preferably used according to the invention.

In the nickel plating bath, the fine carbonaceous particles are preferably dispersed in an amount of from about 0.1 g/l to about 100 g/l, and more preferably 1 g/l to 20 g/l. Although an excess amount of the fine particles exerts no appreciable influences on the hydrogen overvoltage of the cathode, the uniform dispersion of the fine particles in the nickel plating bath becomes difficult. On the other hand, when the amount is too small, insufficient reduction in the hydrogen overvoltage results.

In order to disperse the fine carbonaceous particles in the nickel plating bath, it is necessary to apply appropriate stirring. For this purpose, a method in which gas is bubbled into the nickel plating bath, a method in which the liquid is recycled, and a method in which a stirrer is used can be employed. In a small scaled dispersion, a magnetic stirrer can be used for the purpose. When stirring is insufficient, a uniformly plated product cannot be obtained, and when the stirring is performed excessively, no active plated product can be obtained.

On continuing the plating procedure over a long period of time, fine carbonaceous particles are consumed, and in particular, the proportion of finer carbonaceous particles is decreased. In this case, it is preferred that all fine particles are removed by the use of a precoat filter (i.e., a filter coated with a filtration aid such as active carbon, diatomaceous earth) and fresh fine particles are introduced.

The term "nickel plating bath" used herein refers to a plating bath for forming a plated layer of nickel or a nickel alloy composed mainly of nickel and containing at least one element selected from cobalt, iron, silver, copper, phosphorus, tungsten, magnesium, titanium, molybdenum, beryllium, chromium zinc, manganese, tin, lead, and bismuth (hereinafter these elements are called "alloy component elements") on the surface of the electrode substrate.

Nickel plating baths which can be used in this invention include conventional nickel plating baths such as a nickel sulfamate bath, a nickel sulfate bath, a nickel chloride bath, a nickel bromide bath, and a mixed bath thereof. Preferred examples of the nickel plating baths include a bath containing nickel sulfamate or nickel sulfate as a major ingredient and additionally nickel chloride and boric acid, and a bath having the same formulation as above except that nickel bromide is used in place of nickel chloride.

Many of conventional nickel plating baths exemplified by a nickel sulfamate bath, a nickel sulfate bath, and a nickel chloride bath usually contain not only nickel but also cobalt. The cobalt content can vary within a wide range, e.g., 0.01 to 10 wt%, based on the total content of nickel and cobalt.

In forming a plated layer of a nickel-cobalt alloy on the surface of the electrode substrate, the cobalt contained in the nickel plating bath as described above may be utilized as the alloy component element, or the desired formulation of the bath may be prepared by removing a part of the cobalt contained therein, or by adding cobalt in the form of a water-soluble salt. By using a cobalt-containing plate as a counter electrode in electric plating, the cobalt dissolved in the nickel plating bath during plating may be utilized as the alloy component element.

In forming plated layers of other nickel alloys, alloy component elements may be incorporated in the form of water-soluble salts, e.g., salts bonded to anions contained in the plating bath.

The ratio of nickel to alloy component element in the plating bath is not particularly critical in the invention. The formulation of the plating bath is so determined that in the alloy layer formed on the surface of the electrode substrate nickel is present as a major ingredient, and the alloy component element constitutes the remainder, particularly preferably from 1 to 49% by weight of the alloy layer. The composition of the alloy elements on the surface of the substrate can be determined by a method in which a part of the plated layer is stripped away, dissolved, and measured by, for example, an atomic absorption method.

Such alloy component elements in the alloy improve the adhesion of the plated layer to the substrate and increase the hardness of the plated layer, and thus the nickel alloy plated layer is advantageous. When the amount of the alloy component element is too small, the advantages thereof are lost, whereas when it is too large, the corrosion resistance of nickel tends to be reduced. Thus, it is preferred that the alloy component element is present in the plated layer within the range as described above.

To the nickel plating bath of this invention may be added one or more metals, other than the alloy component element (if any) noted above, selected from copper, chromium, aluminum, tin, zinc, barium, silver, platinum, rhodium, iridium and palladium in an amount of 5,000 ppm or less based on the total weight of the plating bath. These metals constitute a part of the plated layer. Of these metals, platinum, rhodium, iridium and palladium are preferred. Addition of such metals improves the activity of the cathode obtained and provides a cathode showing a lower hydrogen overvoltage.

The particularly preferred concentration range of each metal is shown below, which varies depending upon the particular metal.

| | |
|---|---|
| $Cu^{++}$: | 0.5 to 250 ppm |
| $Cr^{++}$ or $Cr^{+++}$: | 50 to 2,000 ppm |
| $Al^{+++}$: | 50 to 5,000 ppm |
| $Sn^{++}$: | 50 to 5,000 ppm |
| $Zn^{++}$: | 50 to 5,000 ppm |
| $Ba^{++}$: | 50 to 5,000 ppm |
| $Ag^{+}$: | 50 to 5,000 ppm |
| $Pt^{++}$ or $Pt^{++++}$: | 5 to 3,000 ppm |
| $Rh^{+++}$: | 5 to 300 ppm |
| $Ir^{++}$ or $Ir^{+++}$ or $Ir^{++++}$: | 10 to 3,000 ppm |
| $Pd^{++}$: | 1 to 300 ppm |

It is preferred to add these metals to the plating bath in the form of a salt thereof. These metals are generally present in the plating bath in the form of an ion. Some metals, however, are present in the form of a salt.

While conventional nickel plating baths can be used in the invention as described above, sulfur-precipitating compounds such as thiourea, thiocyanates, thiosulfates, sulfites, and thioglycolic acid, and phosphorus-precipitating compounds such as phosphites may further be added in the plating baths.

In applying the electric plating using the nickel plating bath in accordance with the process of the invention, it is desirable to select appropriate plating conditions such as a plating bath composition, a plating temperature, a plating current density, a counter electrode, and a pH of a plating liquid. For example, in the case of a nickel sulfamate bath, the pH is preferably within the range of 1.5 to 5.5. Within this pH range, cathodes having almost uniform activities can be obtained. The plating temperature is generally within the range of from about 20° C. to 60° C., although it is not critical. The plating current density is from about 0.1 $A/dm^2$ to 15 $A/dm^2$, and preferably from 0.5 $A/dm^2$ to 5 $A/dm^2$. When the plating current density is excessively low or high, a plated product having good adhesion and a high degree of activity cannot be obtained. As the counter electrode for use in this plating, a nickel electrode for nickel plating is preferred. In addition, valve metals prepared by coating a platinum group metal, and graphite can be used.

The thickness of the plated layer is at least several microns, preferably 20 microns or more, calculated as pure nickel, in view of the desired lifetime of the cathode.

In order to improve the adhesiveness between the plated layer and the electrode substrate, nickel plating, or sulfur-containing nickel plating may further be performed on the plated layer.

As described hereinbefore, the process of the invention permits production of a cathode for the generation of hydrogen gas at low cost by a very simple procedure. Furthermore, the cathode obtained has a very low hydrogen overvoltage and a very long life. The cathode is useful as a cathode for the electrolysis of an aqueous solution of alkali compound such as sodium chloride and potassium chloride using an asbestos diaphragm or ion exchange membrane. In addition, it is useful as a cathode of an apparatus for the electrolysis of water.

The following examples are given to illustrate the invention in greater detail.

EXAMPLE 1

An electrode substrate, a cylindrical nickel bar having a diameter of 3 mm, was etched by soaking in hydrochloric acid at 80° C. for 30 minutes and then electrically plated under the conditions shown below.

| | |
|---|---|
| Plating Bath: | |
| Nickel sulfamate | 300 g/l |
| Nickel chloride | 5 g/l |
| Boric acid | 40 g/l |
| Fine granular active carbon (KV-3 produced by Futamure Kabaku K.K., Japan, comprising 70% or more of particles having a grain size of 100 microns or less) | 5 g/l |
| Plating Conditions: | |
| pH of plating bath | 3.6 |
| Counter electrode | electrolytic nickel |

-continued

| | |
|---|---|
| | plate |
| Temperature | 40° C. |
| Plating current density | 1 A/dm$^2$ |
| Plating time | 2 hours |

Hydrogen generation potential of the thus obtained nickel plated product was measured in a 20% KOH solution at 60° C. and 20 A/dm$^2$ with a Hg/HgO electrode as the reference electrode it was found to be −1.15 V.

The same procedure as described above was repeated with the exception that the pH of the plating bath was changed to 2, 3, 4 or 5. The potential of each plated product obtained was measured in the same manner as described above and the results are shown in Table 1 below.

TABLE 1

| pH of Plating Bath | Potentail (V) |
|---|---|
| 2 | −1.16 |
| 3 | −1.15 |
| 4 | −1.15 |
| 5 | −1.13 |

For comparison, a cylindrical nickel bar as used above was etched under the same conditions as described above, and the potential of the thus etched nickel round bar was measured and found to be −1.35 V. In addition, a cylindrical soft steel bar having the same diameter as the nickel bar was soaked in hydrochloric acid at 60° C. for 30 minutes, and the potential of the mild steel bar was measured and found to be −1.36 V.

It can be seen that there is a significant difference in the potential between the electrode of the invention and the two comparative electrodes.

EXAMPLE 2

An electrode substrate, a cylindrical nickel bar as in Example 1, was etched under the same conditions as in Example 1, and the thus etched nickel bar was electrically plated under the conditions shown below.

| | |
|---|---|
| Plating Bath: | |
| Nickel sulfate | 84 g/l |
| Nickel chloride | 30 g/l |
| Ammonium chloride | 4.5 g/l |
| Potassium chloride | 6 g/l |
| Boric acid | 30 g/l |
| Fine granular active carbon (KV-3) | 5 g/l |
| Plating Conditions: | |
| pH of plating bath | 3.5 |
| Counter electrode | electrolytic nickel plate |
| Temperature | 40° C. |
| Plating current density | 2 A/dm$^2$ |
| Plating time | 2 hours |

Hydrogen generation potential of the thus obtained plated product was measured in the same manner as in Example 1 and found to be −1.16 V.

EXAMPLE 3

A cylindrical iron bar having a diameter of 3 mm was etched by soaking in hydrochloric acid at 60° C. for 30 minutes, and then electrically plated under the conditions shown below.

| | |
|---|---|
| Plating Bath: | |
| Nickel chloride | 240 g/l |
| Hydrochloric acid | 100 g/l |
| Plating Conditions: | |
| Plating current density | 3 A/dm$^2$ |
| Counter electrode | electrolytic nickel plate |
| Plating time | 3 minutes |

The thus-obtained nickel plated product was electrically plated as an electrode substrate in the same manner as in Example 1, with the exception that the pH was about 4. The resulting electrode had hydrogen generation potential of −1.14 V.

EXAMPLE 4

A cylindrical copper bar having a diameter of 3 mm was washed with hydrochloric acid and was subjected to the same electric plating as in Example 1, except that the pH was about 4. The potential of the thus-obtained electrode was −1.14 V.

EXAMPLE 5

An electrode substrate as used in Example 1 was electrically plated under the same conditions as in Example 1, with the exception that copper ions were added to the plating bath in the form of copper sulfate in the amount of 30 ppm or 0.3 ppm. With the thus obtained cathodes, the potential was measured, and the results are shown in Table 2.

TABLE 2

| Amount of Copper Ion added (ppm) | Potential (V) |
|---|---|
| 30 | −1.01 |
| 3 | −1.03 |
| 0.3 | −1.13 |

EXAMPLE 6

A cylindrical copper bar having a diameter of 3 mm was washed with hydrochloric acid and electrically plated under the same conditions as in Example 5 using a plating bath containing 30 ppm of copper ion. The potential of the thus obtained cathode was measured and found to be −0.99 V.

EXAMPLE 7

A cylindrical nickel bar having a diameter of 3 mm was used as an electrode substrate. The electrode substrate was etched by soaking in 5N to 6N hydrochloric acid at 80° C. for 30 minutes, and it was then electrically plated under the plating conditions shown below using the following plating baths containing various amounts of Pt, Rh, Ir or Pd (added in the form of a chloride thereof).

| | |
|---|---|
| Plating Bath: | |
| Nickel sulfamate | 300 g/l |
| Nickel chloride | 5 g/l |
| Boric acid | 40 g/l |
| Fine granular active carbon (KV-3) | 5 g/l |
| Platinum group metal (Pt, Rh, Ir, Pd) | see the FIG. |
| Plating Conditions: | |
| pH of plating bath | 3.6 |
| Counter electrode | electrolytic nickel plate |
| Temperature | 40° C. |
| Plating current density | 1 A/dm$^2$ |

-continued

| | |
|---|---|
| Plating time | 2 hours |

With the thus produced nickel-plated bars, the hydrogen generation potential was measured in the same manner as in Example 1. The relationship between the concentration of the platinum group metal and the hydrogen generation potential is shown in the FIGURE.

In the FIGURE, Curves 1, 2, 3, and 4 indicate the relationships when Pt, Rh, Ir and Pd, respectively, were added in various amounts.

EXAMPLE 8

A nickel bar and a soft steel bar were subjected to the same etching treatment as in Example 7 and then electrically plated under the plating conditions shown below using the following plating bath containing a small amount of Pt, Rh, Ir, or Pd as shown in Table 3.

The hydrogen generation potential was measured, and the results are shown in Table 3.

| | |
|---|---|
| Plating Bath: | |
| Nickel sulfate | 84 g/l |
| Nickel chloride | 30 g/l |
| Ammonium chloride | 4.5 g/l |
| Potassium chloride | 6 g/l |
| Boric acid | 30 g/l |
| Fine Granular active carbon (KV-3) | 5 g/l |
| Platinum group metal (Pt, Rh, Ir, Pd) | see Table 3 |
| Plating Conditions: | |
| pH of plating bath | 3.5 |
| Counter electrode | electrolytic nickel plate |
| Temperature | 40° C. |
| Plating current density | 2 A/dm$^2$ |
| Plating time | 2 hours |

TABLE 3

| Metal added | | Potential (V) | |
|---|---|---|---|
| Kind | Concentration (ppm) | Ni Bar | Soft Steel Bar |
| Pt | 30 | −1.03 | −1.05 |
| Rh | 30 | −1.02 | −1.03 |
| Ir | 100 | −1.01 | −1.00 |
| Pd | 30 | −0.99 | −0.98 |

EXAMPLE 9

Using each plated bar produced in Example 8, hydrogen was generated in a 20% KOH solution at 150 A/dm$^2$ and room temperature for 200 hours. Thereafter, the potential was measured, and the results are shown in Table 4.

TABLE 4

| | Potential (V) | |
|---|---|---|
| Plating Bath | Ni Bar | Soft Steel Bar |
| Pt-containing bath | −1.02 | −1.04 |
| Rh-containing bath | −1.02 | −1.05 |
| Ir-containing bath | −1.04 | −1.01 |
| Pd-containing bath | −0.09 | −0.99 |

It is apparent from the results that the plated bars show stable potential over a long period of time.

EXAMPLE 10

A nickel bar having a diameter of 3 mm was used as an electrode substrate. The electrode substrate was etched by soaking in 5N to 6N hydrochloric acid at 80° C. for 30 minutes. Also, a soft steel bar having a diameter of 3 mm was etched by soaking in hydrochloric acid having the same concentration as above at 60° C. for 30 minutes. Thereafter, these bars were electrically plated under the conditions shown below.

| | |
|---|---|
| Plating Bath: | |
| Nickel sulfate | 84 g/l |
| Cobalt sulfate | 5 g/l |
| Nickel chloride | 30 g/l |
| Ammonium chloride | 4.5 g/l |
| Potassium chloride | 6 g/l |
| Boric acid | 30 g/l |
| Fine granular active carbon (KV-3) | 5 g/l |
| Plating Conditions: | |
| pH of plating bath | 3.5 |
| Counter electrode | graphite |
| Temperature | 40° C. |
| Plating current density | 2 A/dm$^2$ |
| Plating time | 2 hours |

With the thus produced plated-bars, the hydrogen generation potential was measured in the same manner as in Example 1. The hydrogen generation potential was −1.14 V in the case of the Ni bar, and −1.15 V in the case of the soft steel bar.

EXAMPLE 11

The procedure of Example 10 was repeated with the exception that Pt, Rh, Ir or Pd was added to the plating bath. The results are shown in Table 5.

TABLE 5

| Metal added | | Potential (V) | |
|---|---|---|---|
| Kind | Concentration (ppm) | Ni Bar | Soft Steel Bar |
| Pt | 30 | −1.04 | −1.04 |
| Rh | 30 | −1.01 | −1.03 |
| Ir | 100 | −1.01 | −1.03 |
| Pd | 30 | −1.00 | −1.01 |

EXAMPLE 12

A nickel bar having a diameter of 3 mm was used as an electrode substrate. The electrode substrate was etched by soaking in 5N to 6N hydrochloric acid at 80° C. for 30 minutes. Also, a soft steel bar having a diameter of 3 mm was etched by soaking at 60° C. for 30 minutes. Thereafter, the nickel and soft steel bars were electrically plated under the plating conditions shown below using the following plating baths containing very small amount of metals as described below.

| | |
|---|---|
| Plating Bath: | |
| Nickel sulfamate | 300 g/l |
| Cobalt sulfamate | 0.1 g/l |
| Nickel chloride | 5 g/l |
| Boric acid | 40 g/l |
| Fine granular active carbon (KV-3) | 5 g/l |
| Plating Conditions: | |
| pH of plating bath | 3.6 |
| Counter electrode | plate containing 99.0 wt % of Ni and about 1 wt % of Co |
| Temperature | 40° C. |
| Plating current density | 2 A/dm$^2$ |
| Plating time | 2 hours |

Small Amounts of Metals added in Plating Bath:

| | | |
|---|---|---|
| Cu | 100 ppm | added as copper sulfate |
| Cr | 500 ppm | added as chromium trichloride |
| Al | 1,000 ppm | added as aluminum trichloride |
| Sn | 1,000 ppm | added as tin chloride |
| Zn | 1,000 ppm | added as zinc chloride |
| Ba | 1,000 ppm | added as barium hydroxide |

-continued

| | | |
|---|---|---|
| Ag | 1.000 ppm | added as silver nitrate |

With the thus produced plated bars, the hydrogen generation potential was measured in the same manner as in Example 1. The results are shown in Table 6.

It can be seen from the results that the addition of small amounts of such metals leads to reduction in the hydrogen overvoltage.

The Ni-Co alloy constituting the surface of the plated bar was substantially composed of 98.5 wt% Ni and 1.5 wt% Co.

TABLE 6

| | Potential (V) | |
|---|---|---|
| | Ni Bar | Soft Steel Bar |
| Etching only | −1.35 | −1.36 |
| Plating without the small amount of metal | −1.15 | −1.14 |
| Plating with the small amount of metal | | |
| Cu | −1.02 | −1.02 |
| Cr | −1.03 | −1.04 |
| Al | −1.01 | −1.02 |
| Sn | −1.01 | −1.00 |
| Zn | −1.01 | −1.00 |
| Ba | −1.03 | −1.04 |
| Ag | −1.01 | −1.02 |

EXAMPLE 13

Electrode substrates as used in Example 10 were electrically plated under the plating conditions shown below using the following plating baths containing the same amounts of the metals as in Example 12. The results are shown in Table 7.

| | |
|---|---|
| Plating Bath: | |
| Nickel sulfate | 84 g/l |
| Nickel chloride | 30 g/l |
| Ammonium chloride | 4.5 g/l |
| Potassium chloride | 6 g/l |
| Boric acid | 30 g/l |
| Fine granular active carbon (KV-3) | 5 g/l |
| Plating Conditions: | |
| pH of plating bath | 3.5 |
| Counter electrode | plate containing 90% of Ni and 10% of Co |
| Temperature | 40° C. |
| Plating current density | 2 A/dm$^2$ |
| Plating time | 2 hours |

TABLE 7

| | Potential (V) | |
|---|---|---|
| Metals added | Ni Bar | Soft Steel Bar |
| Cu | −1.03 | −1.04 |
| Cr | −1.03 | −1.02 |
| Al | −1.01 | −1.00 |
| Sn | −1.00 | −1.02 |
| Zn | −1.02 | −1.03 |
| Ba | −1.03 | −1.01 |
| Ag | −1.00 | −1.02 |

The Ni-Co alloy constituting the surface of the plated bar was substantially composed of 90 wt% Ni and 10 wt% Co.

EXAMPLE 14

Each of the plated products obtained adding small amounts of metals in Example 12 was further electrically plated under the conditions shown below.

| | |
|---|---|
| Plating Bath: | |
| Nickel sulfate | 84 g/l |
| Nickel chloride | 30 g/l |
| Ammonium chloride | 4.5 g/l |
| Potassium chloride | 6 g/l |
| Boric acid | 30 g/l |
| Thiourea | 5 g/l |
| Plating Conditions: | |
| pH of plating bath | 3.5 |
| Counter electrode | 99.9% Ni plate |
| Temperature | 40° C. |
| Plating current density | 2 A/dm$^2$ |
| Plating time | 10 minutes |

The potential of each plated product after the plating is shown in Table 8.

TABLE 8

| | Potential (V) | |
|---|---|---|
| Metals added | Ni Bar | Soft Steel Bar |
| Cu | −1.04 | −1.04 |
| Cr | −1.03 | −1.03 |
| Al | −1.02 | −1.01 |
| Sn | −1.00 | −1.01 |
| Zn | −1.01 | −1.03 |
| Ba | −1.03 | −1.01 |
| Ag | −1.01 | −1.03 |

It can be seen from the results shown in Tables 6 and 8 that the potential is not substantially changed by further nickel plating, and the adhesion strength of the plated product is increased. Thus, the mechanical strength of the plated product is improved.

EXAMPLE 15

A nickel bar having a diameter of 3 mm was used as a substrate. The substrate was etched by soaking in 5N to 6N hydrochloric acid at 80° C. for 30 minutes. Also, a soft steel bar was etched by soaking at 60° C. for 30 minutes. Thereafter, the nickel and soft steel bars were electrically plated under the conditions shown below.

| | |
|---|---|
| Plating Bath: | |
| Nickel sulfate | 84 g/l |
| Potassium molybdenate | 15 g/l |
| Sodium citrate | 90 g/l |
| Fine granular active carbon (KV-3) | 5 g/l |
| Plating Conditions: | |
| pH of plating bath | 7 |
| Counter electrode | graphite |
| Temperature | 30° C. |
| Plating current density | 2 A/dm$^2$ |
| Plating time | 2 hours |

With the thus produced plated products, the hydrogen generation potential was measured in the same manner as in Example 1. The hydrogen generation potential was −1.16 V in the case of the nickel bar and −1.14 V in the case of the soft steel bar.

On the other hand, the same procedure as above was repeated with the exception that the fine granular active carbon only was removed from the plating bath. The hydrogen generation potential was −1.35 V in both the Ni bar and soft steel bar.

EXAMPLE 16

A nickel bar and a soft steel bar were etched under the same conditions as in Example 15 and electrically plated under the conditions shown below.

| | |
|---|---|
| Plating Bath: | |
| Nickel sulfate | 23 g/l |
| Ferrous sulfate | 12 g/l |
| Sodium chloride | 9.5 g/l |
| Boric acid | 25 g/l |
| Saccharin | 0.8 g/l |
| Sodium sulfate | 0.1 g/l |
| Fine granular active carbon (KV-3) | 5 g/l |
| Plating Conditions: | |
| pH of plating bath | 2.5 |
| Counter electrode | electrolytic nickel plate |
| Temperature | 40° C. |
| Plating current density | 2 A/dm$^2$ |
| Plating time | 2 hours |

With the thus produced plated products, the hydrogen generation potential was measured in the same manner as in Example 15. The hydrogen generation potential was −1.12 V in the case of the Ni bar and −1.16 V in the case of the soft steel bar.

EXAMPLE 17

The procedure of Example 15 was repeated with the exception that Pt, Rh, Ir or Pd was added to the plating bath. The results are shown in Table 9.

TABLE 9

| Metal added | | Potential (V) | |
|---|---|---|---|
| Kind | Concentration (ppm) | Ni Bar | Soft Steel Bar |
| Pt | 30 | −1.04 | −1.04 |
| Rh | 30 | −1.01 | −1.03 |
| Ir | 100 | −1.01 | −1.03 |

TABLE 9-continued

| Metal added | | Potential (V) | |
|---|---|---|---|
| Kind | Concentration (ppm) | Ni Bar | Soft Steel Bar |
| Pd | 30 | −1.00 | −1.01 |

While the invention has been described in detail and with reference to specific embodiments thereof, it will be apparent to one skilled in the art that various changes and modifications can be made therein without departing from the spirit and scope thereof.

What is claimed is:

1. In a process for generating hydrogen gas by electrolysis of an aqueous alkali solution, the improvement comprising using a cathode produced by electrically plating the surface of an electrode substrate in a nickel plating bath having fine carbonaceous particles dispersed therein.

2. A process as in claim 1, wherein the fine carbonaceous particles dispered in the plating bath are particles of carbon selected from the group consisting of charcoal, coal, bone carbon, graphite, active carbon, carbon black, and coke.

3. A process as in claim 2, wherein the fine carbonaceous particles are particles of active carbon made from wood or cocoanut husk.

4. A process as claim 1, wherein the fine carbonaceous particles dispersed in the plating bath contain at least 50 wt% of particles having grain size of 100 microns or less.

5. A process as in claim 1, wherein the fine carbonaceous particles dispersed in the plating bath are dispersed in an amount of from about 0.1 g/l to 100 g/l.

6. A process as in claim 5, wherein the fine carbonaceous particles dispersed in the plating bath are dispersed in an amount of from 1 g/l to 20 g/l.

7. A process as in claim 1, wherein the hydrogen gas is generated by the electrolysis of a solution selected from the group consisting of an aqueous solution of alkali chlorides, an aqueous solution of alkali hydroxides, and an aqueous solution of alkali carbonates.

8. A process as in claim 7, wherein the aqueous solution of alkali chlorides is an aqueous solution of sodium chloride or potassium chloride.

* * * * *